US006210125B1

(12) United States Patent
Eller et al.

(10) Patent No.: US 6,210,125 B1
(45) Date of Patent: Apr. 3, 2001

(54) WATER SYSTEM WITH BOTH ELECTRIC MOTOR POWER AND MANUAL PEDAL POWER, FOR A RECIPROCATING PUMP

(75) Inventors: James David Eller; Dana J. Eller; Daren J. Eller, all of Deerfield Beach, FL (US)

(73) Assignee: MWI Corporation, Deerfield Beach, FL (US)

( * ) Notice: Subject to any disclaimer, the term of this patent is extended or adjusted under 35 U.S.C. 154(b) by 0 days.

(21) Appl. No.: 09/075,540

(22) Filed: May 11, 1998

Related U.S. Application Data

(63) Continuation-in-part of application No. 08/415,483, filed on Apr. 3, 1995, now Pat. No. 5,772,405.

(51) Int. Cl.[7] ..... F04B 17/06

(52) U.S. Cl. ..... 417/233; 417/374; 417/319; 74/625; 74/44

(58) Field of Search ..... 417/319, 374, 417/233; 74/625, 44; 192/48.92

(56) References Cited

U.S. PATENT DOCUMENTS

| | | | | |
|---|---|---|---|---|
| 194,377 | | 8/1877 | Schenck | 92/76 |
| 344,133 | | 6/1886 | Philippe | 417/536 |
| 350,805 | | 10/1886 | Chew | 417/552 |
| 705,425 | | 7/1902 | Musser | 74/105 |
| 1,101,410 | | 6/1914 | Cooper | 417/545 |
| 1,303,975 | * | 5/1919 | Sjorb | 417/625 |
| 1,358,213 | | 11/1920 | Joerns | 74/41 |
| 1,592,021 | | 7/1926 | De Lew et al. | 74/432 |
| 1,756,089 | | 4/1930 | Hunter | 74/37 |
| 1,830,941 | * | 11/1931 | Hild | 417/374 |
| 2,150,276 | * | 3/1939 | Gorman | 417/374 |
| 2,292,527 | * | 8/1942 | Kraft | 417/374 |
| 2,382,667 | * | 8/1945 | Ryan | 417/625 |
| 2,552,762 | * | 5/1951 | Baker | 417/374 |

(List continued on next page.)

OTHER PUBLICATIONS

Arlosoroff, Grey, Journey, Karp, Langenegger, Rosenhall, Tschannerl, World Bank Technical Paper No. 29, The World Bank, Washington, D.C. USA pp. 155,257,265,267 1984.

Arlosoroff, Tschannerl, Grey, Journey, Karp, Langenegger, Roche, Community Water Supply: The Handpump Option The World Bank, Washington, D.C. 49–51,59,106–107, 142–143. 1987.

Maurice Dumaas (Editor) Eileen B. Hennessy (Translator) A History of TEchnology & Invention, Progress Through the Ages, vol. II, The First Stages of Mechanization Crown Publishers, Inc. NY pp. 124 1964.

*Primary Examiner*—Charles G. Freay
*Assistant Examiner*—Robert Z. Evora
(74) *Attorney, Agent, or Firm*—Oltman, Flynn & Kubler

(57) ABSTRACT

A water system includes a reciprocating pump operated by pedal and motor delivered solar power, including one-way engagement clutch elements preventing hazardous pedal movement and potential motor damage. The pumpstand includes a housing in which a foot pedal and a drive shaft rotate. An eccentric pin, rotating with the drive shaft, moves a connecting rod, which in turn causes a pushrod to oscillate vertically. The pushrod extends into a pressure-tight chamber formed above the rising main (well pipe). A pumprod connected to the pushrod extends to move a conventional plunger through vertical oscillations. A flywheel is attached to the drive shaft, and a counterweight is mounted on the flywheel diametrically opposite the eccentric pin. The radial distance from the drive shaft to the counterweight can be adjusted. A discharge pipe extends from the pressure-tight chamber to an elevated or pressurized storage tank. A distribution pipe from the storage tank feeds water to a number of distribution points, such as faucets in houses.

9 Claims, 8 Drawing Sheets

U.S. PATENT DOCUMENTS

| | | | | |
|---|---|---|---|---|
| 3,026,744 | * | 3/1962 | Rouse | 417/319 |
| 3,547,083 | | 12/1970 | Peterson | 119/75 |
| 3,684,410 | | 8/1972 | Fitzgerald et al. | 417/554 |
| 4,008,008 | | 2/1977 | Vergnet | 417/385 |
| 4,087,204 | * | 5/1978 | Niedermeyer | 417/2 |
| 4,293,281 | * | 10/1981 | Lamoreaux | 417/9 |
| 4,303,833 | | 12/1981 | Eckel et al. | 290/1 R |
| 4,475,872 | * | 10/1984 | Foughty | 417/315 |
| 4,515,533 | * | 5/1985 | Gomez | 417/319 |
| 4,580,463 | * | 4/1986 | Allouche et al. | 74/625 |
| 4,638,641 | * | 1/1987 | Taylor | 62/180 |
| 4,834,620 | | 5/1989 | Sweeney | 417/53 |
| 4,886,430 | | 12/1989 | Veronesi et al. | 417/423.13 |
| 5,016,870 | | 5/1991 | Bullock et al. | 272/73 |
| 5,772,405 | * | 6/1998 | Eller | 417/233 |

* cited by examiner

WATER SYSTEM WITH BOTH ELECTRIC MOTOR POWER AND MANUAL PEDAL POWER, FOR A RECIPROCATING PUMP

FILING HISTORY

This application is a continuation-in-part of application Ser. No. 08/415,483, filed on Apr. 3, 1995, now U.S. Pat. No. 5,772,405.

BACKGROUND OF THE INVENTION

1. Field of the Invention

This invention relates to water distribution systems, and more particularly, to water distribution systems powered by human power. The history of positive displacement reciprocating pumps goes back as far as 275 BC in Ancient Rome. In the sixteenth century, great lift and force pumps, driven by water wheels became the principle method for pumping water to be piped in Europe.

As late as 1987, the World Bank estimated that, throughout the world, 1.8 billion people would need improved water supplies, and that wells equipped with handpumps would be an appropriate choice to meet the needs of this number of people. Most of the reciprocating handpumps commonly used in developing countries have their origins in designs developed during the late 19th and early 20th Centuries in the United States and in Europe. In the United States, about 42 million handpumps were made until 1920, when electric pumps began to replace them. While the basic design of the reciprocating handpump has not changed much in this century, its typical use has changed greatly. In the early part of this century, in the United States and Europe, the big market for pumps was for small backyard pumps used for ten to thirty minutes per day by individual families or farmers. In a developing country today, a single pump may have to supply more than 500 villagers and may be in continuous operation for ten or more hours per day.

What is needed in a developing country is a manually operated pump which can be easily operated by a person for relatively long periods of time and which lifts significant volumes of water with as little effort as possible. Because of the high usage requirements, and because the pump must operate as a practical device far from cities having maintenance facilities and personnel, the pump must be both reliable and easily repaired. A handpump connected with a typical well is driven by pressing the end of a lever downward and by either pulling it upward, or permitting it to return upward due to the weight of the well. The work of lifting the water occurs as the lever is pressed downward. The simplest type of reciprocating pump is the suction pump, which draws water from shallow wells by creating a partial vacuum in a suction pipe. All of the moving parts, including a plunger moved by the lever and a suction check valve, are located above ground; only the suction pipe extends downward into the well. As the lever is pushed downward, the plunger is moved upward, lifting the water above it to be discharged through a spout, and pulling water below it upward through an open suction check valve. As the lever is moved upward, the plunger is moved downward, through the water below it, creating a pressure which opens a valve in the plunger while closing the suction check valve. Two disadvantages of this type of pump are first, it must be primed with water before it can be used and, second, the suction principle, depending on atmospheric pressure to lift water, limits the usefulness of the device to wells having depths less than about seven meters.

In deepwell reciprocating pumps, the cylinder is immersed within the well below the water level, being pulled up and down by a rod extending down the well pipe. This arrangement is suitable for wells as deep as 45 meters or more, with the operating limit depending on the effort that users are willing to apply for progressively less water at increased depths. As the depth of the well is increased, more work is required to lift the column of water in the well pipe, together with the steel rod extending down the well pipe to the cylinder.

One problem with most reciprocating pumps is caused by the fact that the lever used to operate the pump, while providing an exceedingly simple mechanism, does not make particularly good use of the ability of the human body to do mechanical work. The downward force that a person can provide to lift water in this way is limited by his own weight, and the lever primarily uses the muscles moving the arms and upper body, while, in a typical person, the muscles moving the leg are much stronger and more capable of use for extended times.

Another problem with most reciprocating pumps arises from the fact that the work of lifting the water and the pump mechanism occurs only as the lever is pushed down. For example, a conventional reciprocating pump requires a force of about 20 kg 3 as the lever is pushed down, while a force of only about 4 kg is required to move the lever back upward. Thus, uneven demands are placed on the user to supply energy to the pumping process.

A number of pump configurations have been built to overcome various of these disadvantages in the way driving forces are applied. For example, a treadle type foot pedal drive, together with a pair of flywheels, has been applied to a double piston pump, Model SB-115, produced by the Water Conservancy Bureau of Shandong Province, China. The Climax handpump, manufactured by Wildon Engineering of Worcester, United Kingdom, and the Volanta handpump, manufactured by Jensen Venneboer BV, The Netherlands, are both pumps in which a reciprocating motion is developed using a connecting rod driven by a rotating crank mounted on a shaft along with a flywheel. An eccentric rod extends from the flywheel for use as a hand crank. The Climax handpump also uses a counterweight to balance the lifting force applied through the crank.

Thus, the pump from Shandong Province, China, has the advantage of using the stronger muscles moving the legs, while the flywheels of all three of these types of pumps help to spread the force requirements over the operating cycles through the storage of energy. The counterweight of the Climax handpump provides additional help in evening torque requirements of the hand crank.

Nevertheless, the posture and leg movements of bicycle riding, which are known to be both comfortable and practical for providing mechanical work over an extended period, are not used for power input in these pumps. A bicycle type seating and pedaling arrangement is used to drive centrifugal pumps, Model 1-1/2-JB, produced by the Anyue County Farm Machinery Plant, Sichuan Province, China, and Model Jinshan-402B, produced by the Zhenjiang Sprinkler Plant, Jiangsu Province, China.

What is needed is a pump incorporating the posture and pedal configuration of a bicycle for power input with the simplicity, reliability, and flexibility of application of the reciprocating pump.

The force required to lift the water and rod mechanism of a reciprocating pump varies with the depth of the well. While the counterweight of the Climax pump attempts to balance this force, it cannot be moved to compensate for differences in well depth from one installation to another.

Even within one installation, it is not unusual to increase the depth of a well to compensate for a falling water table. Therefore, what is needed is a way to vary the position of the counterweight to compensate for differences in force resulting primarily from differences in well depth.

The virtues of flywheels and of counterweighting are also discussed by S. Arlosoroff, et al., Community Water Supply The Handpump Option, (The World Bank, Washington, D.C., 1987) indicating that a properly counterbalanced flywheel in a pumping application can build up considerable speed, particularly when it is operated by two people. These editors further point out that counterweights should at least balance the pull of the pump rod and the plunger.

A conventional handpump or other reciprocating pump includes a spout extending outward and slightly downward from a point a few feet above the ground, below the point at which the pump is operated. Thus, at the spout, a rod extends upward through an opening, being attached to a lever or, in the case of the Climax and Volanta pumps, to a drive crank by means of a connecting rod. Since the top of the pump is not sealed, water cannot be raised above the spout by the pump. On the other hand, the electrically powered water pumping systems in developed countries are typically sealed in such a way that a substantial pressure can be developed above the pump. In a typical water system, this pressure is used either to raise the level of the water to an elevated storage level or to inject the water into a pressure tight tank at ground level. Water stored in this way is subsequently dispensed under pressure through a piping system, which may serve an individual rural house or an entire city.

In developing countries, this kind of water distribution is desirable too, although it is not generally achieved in rural areas. A piped system, supplying water for individual houses, provides significant advantages, both in terms of convenience and sanitation. Considering the changes described above in the patterns of usage of manually operated pumps, by which one pump may have to supply water for 500 villagers, what is particularly needed is a water supply system including a reciprocating pump which can be operated by means of a hand crank or pedal system and which can pump water under pressure into an elevated or pressurized tank.

2. Description of the Prior Art

U.S. Pat. No. 1,358,213 to Joerns describes a gear driven reciprocating pump having an upper seal, through which a pair of reciprocating rods operate, and a pressure chamber formed with a division wall and an outlet passageway, allowing the discharge of water near the top of the standard. This feature allows the pump to be operated under considerable pressure for various purposes, discharging a steady stream of water under the pressure of the pump.

While the pump of Joerns shows improvements in the mechanism used to produce reciprocating motion, the gear mechanism is still driven by a handle, or by an unspecified external source of power operating a pulley. What is needed, for the effective application of the Joerns device to the rural areas of a present day developing country, are the other components of a complete water system for supplying water to a number of faucets, together with means allowing the device to be operated by the more efficient process of pedaling.

U.S. Pat. No. 1,592,021 to De Lew et al and U.S. Pat. No. 4,886,430 to Veronesi et al. describe different types of pumping applications in which a flywheel is used. De Lew describes a detachable flywheel for use in a reciprocating oil well pump driven by an electric motor through a walking beam, while Veronesi describes the use of a flywheel, along with an electric motor and a centrifugal pump impeller, within a hermetically sealed casing, through which the fluid being pumped flows.

U.S. Pat. No. 5,016,870 to Bulloch et al describes an exercise device having a bicycle type pedal arrangement used to supply mechanical power to a flywheel, with an adjustable brake creating a variable resistance to the pedaling process.

It is thus an object of the present invention to provide a pedal and solar powered water pumpstand and water distribution system which includes clutch means for preventing forced pedal rotation injury to an operator.

It is another object of the present invention to provide such a pumpstand and water distribution system which includes clutch means for preventing forced rotation damage to a solar powered motor.

It is still another object of the present invention to provide such a pumpstand and water distribution system which includes a pressure tank having means for shutting off the release of water before all of the water is released, to maintain air pressure above the water.

It is a further object of the present invention to provide such a water distribution system which automatically switches pumpstand water flow from the pressure tank when the tank becomes full to another water retaining reservoir of any suitable type.

Still additional objects include providing a pump counterweight to balance the work done during the pumping stroke with work done during the downward stroke in the water pump and providing a counterweight which is radially adjustable to vary counter torque at different riser pump settings; providing flywheel store and release pedal energy at peak torque demand; providing a pressure chamber with a high pressure seal to guide and connect a connecting rod small end to pump rods, and a high pressure seal to allow pressure to build up to pump the water to a pressure tank or overhead reservoir; providing a water filtration system to filter sand and sediments; providing a water treatment system to feed necessary chemicals proportional to the flow and to preserve water when in storage; and providing an automatic control system which diverts pump discharge from a high pressure tank to an overhead reservoir and vice versa, an adjustable pilot valve mounted on the pressure tank which monitors the tank internal pressure, such that when pressure in the tank reaches a desired setting, the pilot valve feeds a signal to operate the sequence valve and divert the flow to the overhead tank, and such that a reverse process occurs when the pressure tank experiences a pressure drop, which further includes a pressure switch in the discharge pipe to the overhead tank, disconnects a solar power supply to the electric motor in the event the overhead tank becomes full, which further includes a pressure relief valve which prevents excessive system pressure due to clogging of the filter or accidental use of the wrong pressure setting on the pilot valve, and which finally includes a non-return check valve installed in the pipe line from the sequence valve to the pressure tank to prevent a reverse flow of water to the overhead tank when the position of the sequence valve is on overhead tank mode.

SUMMARY OF THE INVENTION

The present invention accomplishes the above-stated objectives, as well as others, as may be determined by a fair reading and interpretation of the entire specification.

A pumpstand for driving a pumprod in a vertically reciprocating motion, the pumpstand including a pumpstand housing; a drive shaft rotatably mounted within the housing, with a driven sprocket and a flywheel attached to the drive shaft; a transmission for converting rotary motion of the drive shaft into the vertically reciprocating motion of the pumprod; a counterweight turning with the drive shaft, where the counterweight is raised as the pumprod is lowered, and where the counterweight is lowered as the pumprod raised; an electric motor; a motor driving sprocket; a chain extending between the driving sprocket the driven sprocket, the chain engaging the sprockets so that rotation of the driving sprocket causes rotation of the driven sprocket; and a motor clutch containing a mechanism for rotational engagement in only one rotational direction interconnecting the electric motor and the motor driving sprocket which engages when the electric motor operates to drive the motor driving sprocket and disengages when the motor driving sprocket is driven by the chain without operation of the motor, so that the electric motor is not driven by rotation of the driven sprocket.

A pumpstand for driving a pumprod in a vertically reciprocating motion, the pumpstand including a pumpstand housing; a drive shaft and a drive sprocket rotatably mounted within the housing, and a flywheel attached to the drive shaft; a first driven sprocket and a second driven sprocket mounted on a one-way engagement drive-shaft clutch; a transmission for converting rotary motion of the drive shaft into the vertically reciprocating motion of the pumprod; a counterweight turning with the drive shaft, where the counterweight is raised as the pumprod is lowered, and where the counterweight is lowered as the pumprod is raised; a foot pedal rotatably mounted within the housing, with a pedal driving sprocket attached to the foot pedal; a first chain extending between the driving sprocket and the first driven sprocket, the first chain engaging the sprockets so that rotation of the driving sprocket causes rotation of the first driven sprocket; a second chain extending between the second driven sprocket and the drive sprocket, the second sprocket chain engaging the sprockets so that rotation of the driving sprocket causes rotation of the second driven sprocket; where the drive-shaft clutch contains a mechanism for rotational engagement in only one rotational direction interconnecting the first driven sprocket and the second driven sprocket which engages when the chain drives the first driven sprocket and disengages when the first driven sprocket is driven by the chain without operation of the pedal, so that the pedal is not driven by rotation of the second driven sprocket.

The counterweight is preferably attached to the drive shaft in a manner allowing adjustment of a radial distance between the drive shaft and the counterweight. The flywheel preferably includes a radially extending structure along which the counterweight is attached. The radially extending structure is preferably an aperture slot through which the counterweight is fastened to the flywheel. The transmission preferably includes an eccentric pin turning with the drive shaft; a pushrod extending downward from the pumpstand, the pushrod being mounted to slide vertically; and a connecting rod extending between the eccentric pin and the pushrod, the connecting rod being rotatably mounted on the eccentric pin and pivotally mounted on the pushrod. The pumpstand preferably additionally includes a plate with an aperture through which the pushrod extends within a pressure seal; the plate separating a chamber from a portion of the transmission; and structure for connecting a discharge pipe to the chamber. The pumpstand preferably additionally includes a plate separating a chamber from a portion of the transmission; structure for connecting a discharge pipe to the chamber; and pressure sealed structure for transmitting reciprocating motion through the plate. The pumpstand preferably additionally includes a seat for sitting upon to operate the foot pedal.

A water supply system for delivering underground water to several distribution points, where the system includes a well; a pump connected to the well for extracting water from the well; a pilot operated sequence valve; a water distribution pipe connected to and extending from the pump to the sequence valve; a water storage pressure tank; a first branch pipe extending from the sequence valve to the pressure tank; a water storage reservoir; a second branch pipe extending from the sequence valve to the water storage reservoir; a pilot connected to a sensor in the pressure tank and to the sequence valve, so that when the pressure and water level within the tank reaches a certain point, the pilot sends an hydraulic signal to the sequence valve and thereby causes the sequence valve to divert water flow from the first branch pipe to the second branch pipe and thus to the storage reservoir.

The water supply system preferably additionally includes a pressure switch connected into the second branch pipe, so that when pressure within the second branch pipe reaches a level indicating that the storage reservoir is full, the pressure switch disconnects the solar power supply to the electric motor and stops the further operation of the water pump. The water supply system preferably further includes a filter in the distribution pipe. The water supply system preferably still further includes a water treatment device, and a non-return valve in the first branch pipe between the sequence valve and the pressure tank for preventing reverse flow from the pressure tank to the storage reservoir via the sequence valve.

A water storage pressure tank including a water retaining and pressure tight tank shell having a water outlet opening; a valve float assembly mounted to the outlet opening including a flow control mechanism for opening the outlet opening and a mechanism for closing the outlet opening, and further including a buoyant float structure for indicating by its altitude within the tank shell whether the level of water within the tank shell is above a certain pre-set level, the float structure being connected to the flow control mechanism, so that the flow control mechanism opens the outlet opening the water level within the tank shell is above the certain pre-set minimum level, and so that the flow control mechanism closes the outlet opening when the water level within the tank shell falls to the certain pre-set minimum level, for preventing escape of pressurized air trapped above the water within the tank shell.

The float assembly preferably is mounted upright at the outlet opening, the float assembly including a check valve body having a base fitting including an adaptor portion having structure to sealingly fasten onto the outlet opening; an annular flange portion extending upwardly from the adaptor portion; a cap structure press fitted over the base fitting and including a tubular side wall with a top wall having a top wall central cap recess, the cap recess having a rod port, a water passing cap opening adjacent to the rod port within the cap recess; a float structure including a float body having a lower tube cap rod mounting structure, and a stop rod mounted to the rod mounting structure, the stop rod passing slidingly through the rod port and having a threaded rod lower end fitted with stop means, the stop means permitting the float structure to move upward only to a point at which the stop means abuts a lower end surface of the cap structure, and a gasket seal groove extending around the circumference of the lower end of the floating structure, the gasket seal being seated within the groove and sized to abut the cap structure at the outer edge of the recess to releasibly close water passing cap opening in the cap structure top wall, so that as water is introduced into the tank shell and reaches the certain pre-set minimum level around the float structure, the float structure buoyantly rises until the stop structure abuts the cap structure, opening the water passing cap opening for delivery of water from the tank shell by lifting the gasket seal off the cap structure top wall, and so that once water has drained from the tank shell to an extent that the water level within the tank shell drops to the pre-set minimum level relative to the float structure, the float structure is no longer surrounded by sufficient water to float and drops to rest on the base fitting with the gasket seal abutting and making sealing contact with the cap structure, closing the outlet opening against further passage of water.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
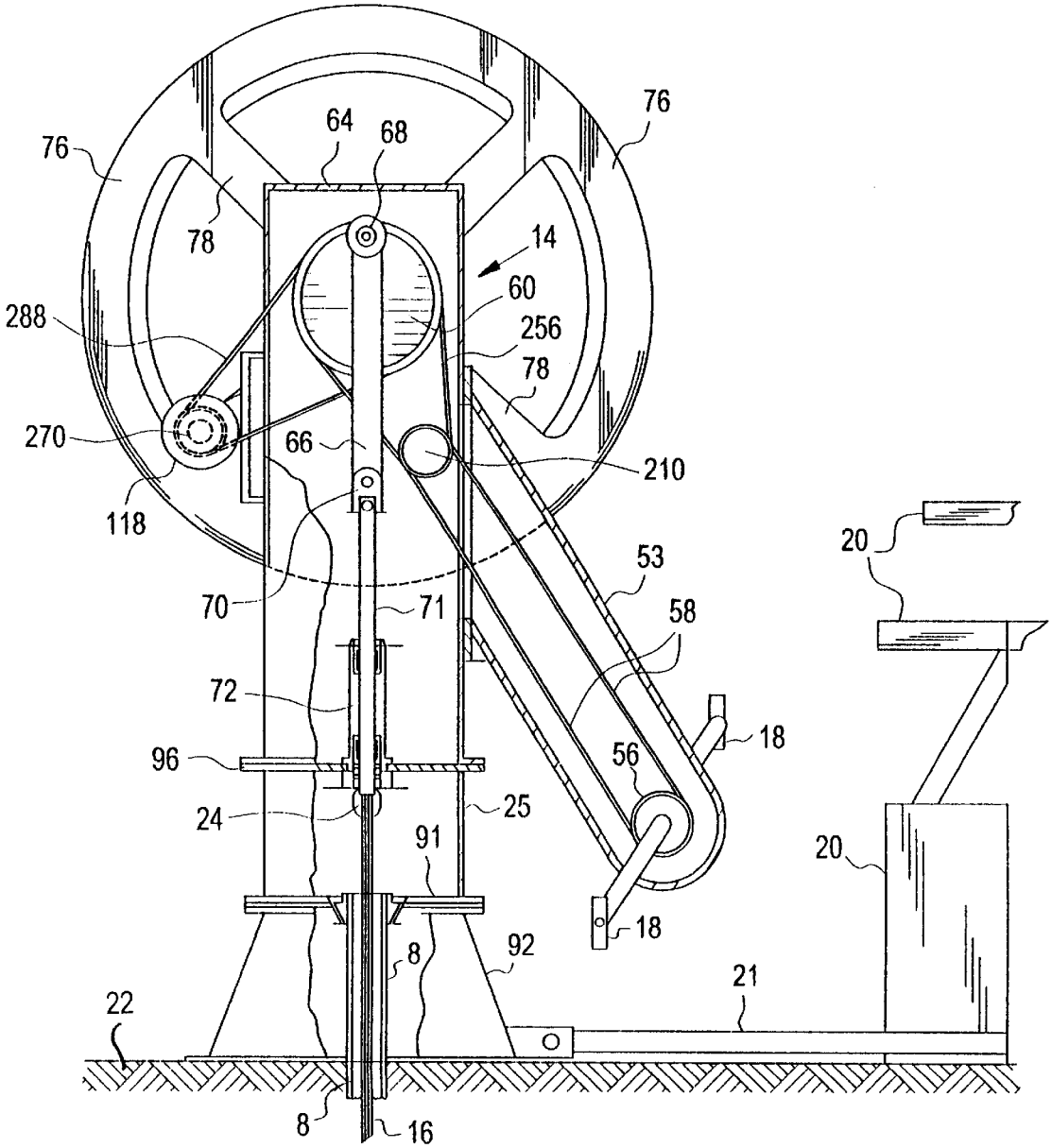
FIG. 1 is a vertical cross-sectional first side view of the inventive pumpstand, taken from the side opposite the flywheel.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

FIRST PREFERRED EMBODIMENT

Figure 13:
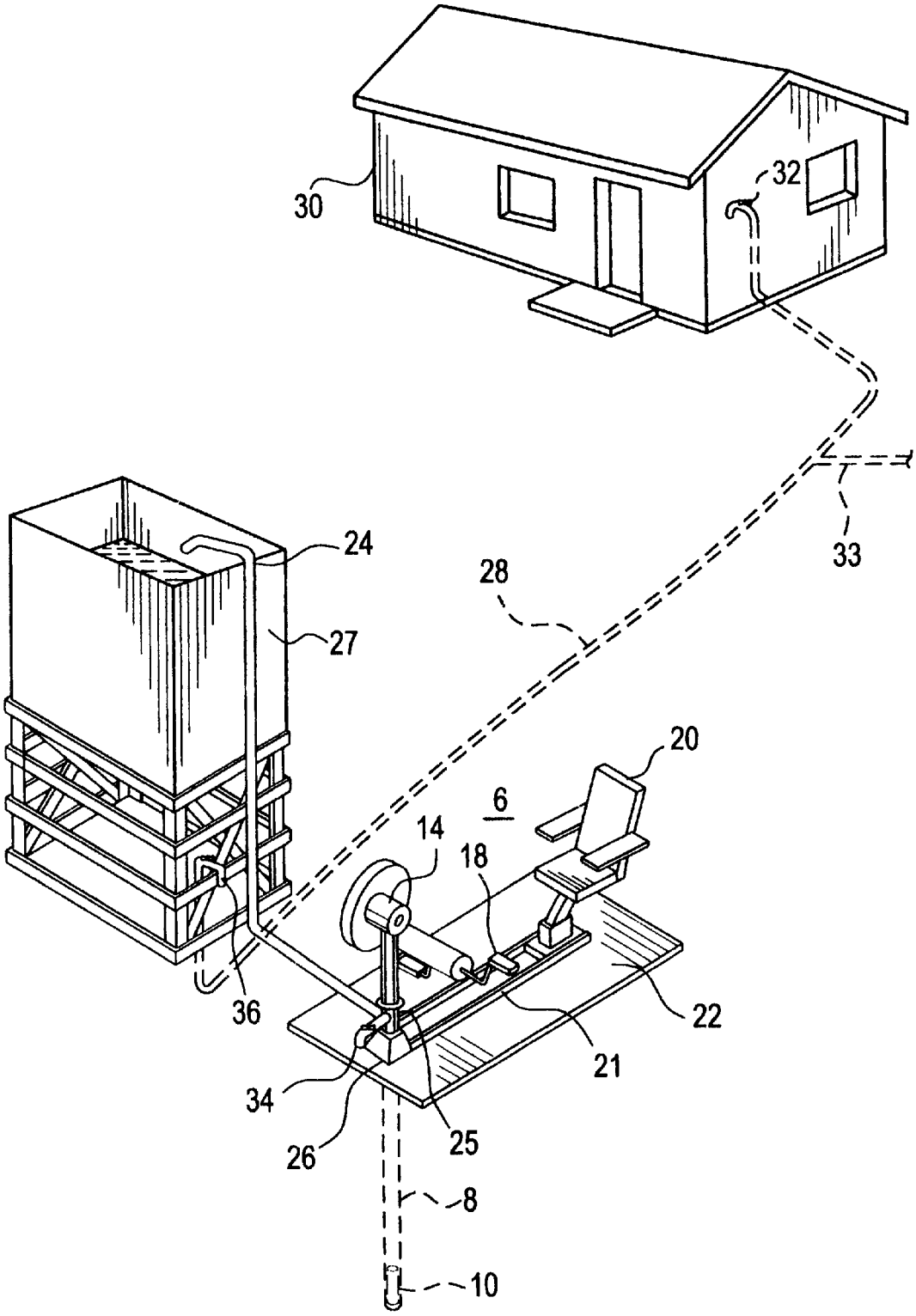
FIG. 13 is a perspective view of various portions of a rural community water supply system built in accordance with the present invention.

FIG. 13 is a perspective view of various portions of a water supply system built in accordance with the present invention. A pumping station 6 includes a rising main 8 (well pipe) descending below the ground to a level at which a cylinder 10, within the rising main 8, is immersed in ground water.

Figure 2:
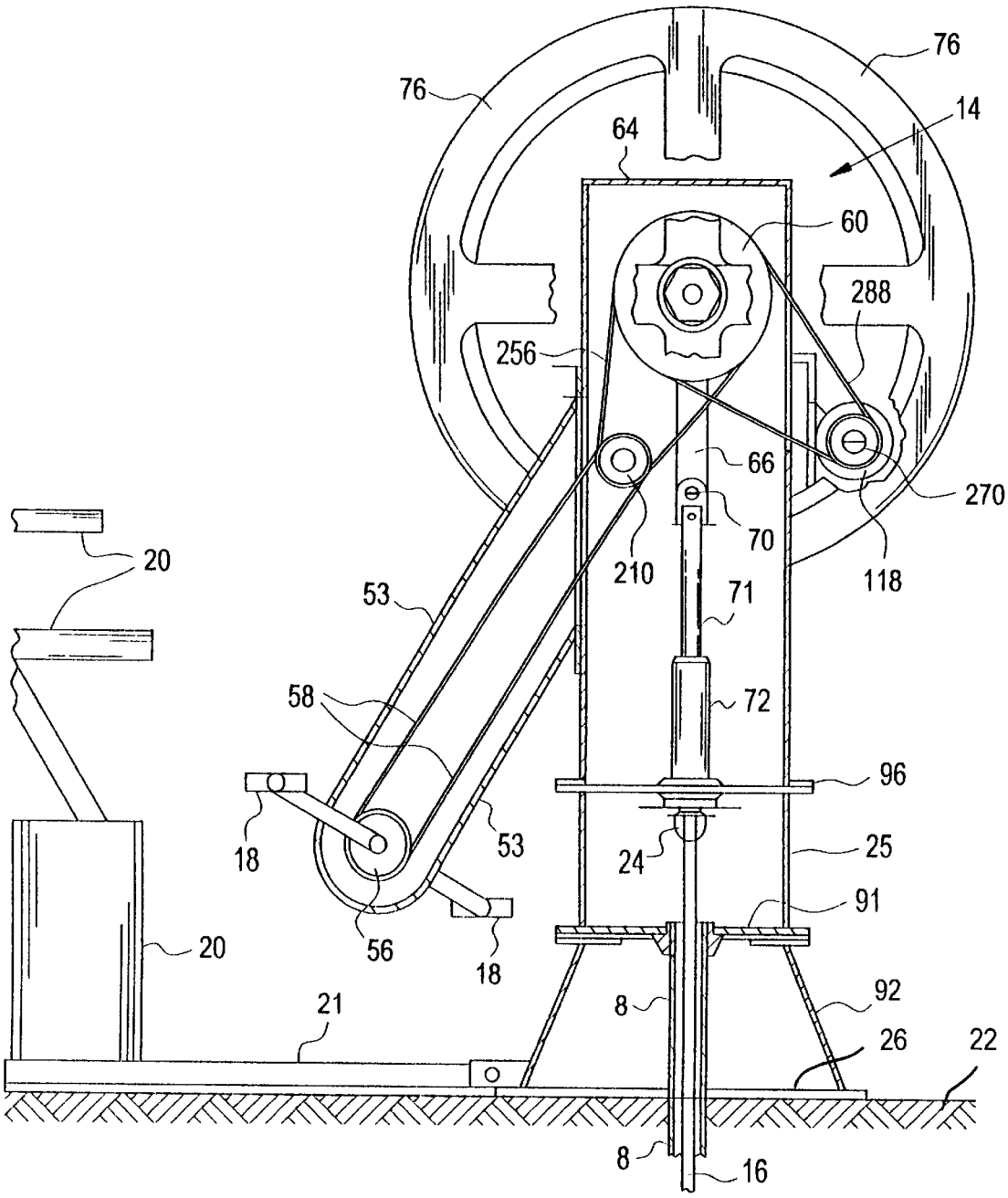
FIG. 2 is a vertical cross-sectional second side view of the inventive pumpstand, taken from the flywheel side.

Generally, and as explained in more detail in FIGS. 1 and 2, within the cylinder, a plunger is raised and lowered in a reciprocating motion by means of a pump rod, which, in turn, is moved by means of a mechanism within a pumpstand 14. The energy required to operate the mechanism within pumpstand 14 is obtained as a person pedals a foot pedal 18, while sitting in a seat 20 in a posture similar to that of a bicycle rider. Seat 20 is attached to pumpstand 14 by means of frame rails 21. Both pumpstand 14 and seat 20 may be mounted on an optional concrete foundation pad 22.

A discharge pipe 24, connected into a pressure tight chamber 25 near a base 26 of pumpstand 14, extends upward to a point above the ground surface to fill an elevated water tank 27. See FIG. 13. A distribution pipe 28 extends downward from the bottom of water tank 27 and outward to provide water to a number of buildings with faucets 32 and other water attachments (not shown). Distribution pipe 28 may be part of a network including other distribution pipes (not shown). A first bibcock 34, at pumpstand 14, and a second bibcock (not shown), at distribution pipe 28, are also provided, to be used for the attachment of a hose (not shown) or for filling water vessels (also not shown). If water is quickly needed when tank 27 is empty, it may be obtained from first bibcock 34 as the pumpstand 14 is operated with foot pedal 18. Alternately, if tank 27 is not empty, water may be obtained from the second bibcock, as well as from faucets 32.

FIG. 2 is a vertical cross section of the mechanism of the cylinder, which is conventional in design, at the bottom of rising main 8. Water enters the cylinder through a suction pipe 40, preferably rising to a groundwater level at or somewhat above the top of the cylinder. A foot valve 42, operates as a check valve, opening with the flow of water into the cylinder, while being otherwise closed. Within the cylinder, a plunger 43 is moved upward and downward in a reciprocating motion by a pumprod 44, which is hooked onto an eyehook portion 45 of a plunger fitting 46. As the plunger moves downward, a plunger valve 48 opens to allow a flow of water through the plunger along a valve seat 50. In this way, the plunger moves downward easily, as the foot valve is closed to prevent the outward flow of water. As the plunger is moved upward, the plunger valve, also operating as a check valve, closes, so that the water above the plunger is lifted. The resulting suction causes the foot valve to open, allowing more water to flow into the cylinder.

Figure 4:
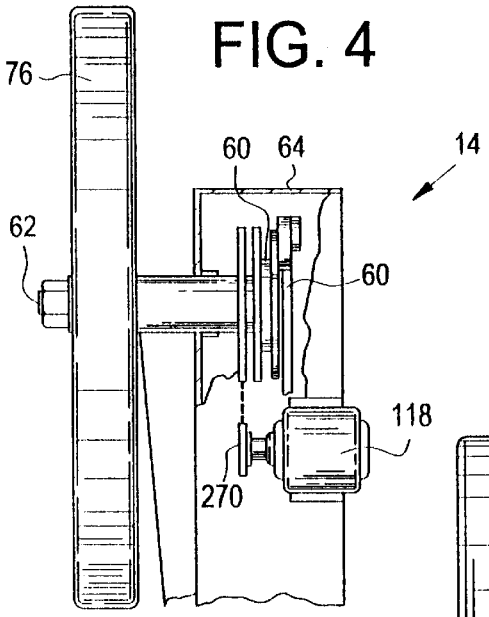
FIG. 4 is a broken-away cross-sectional rear view of the pumpstand of FIGS. 1 and 2.
Figure 3:
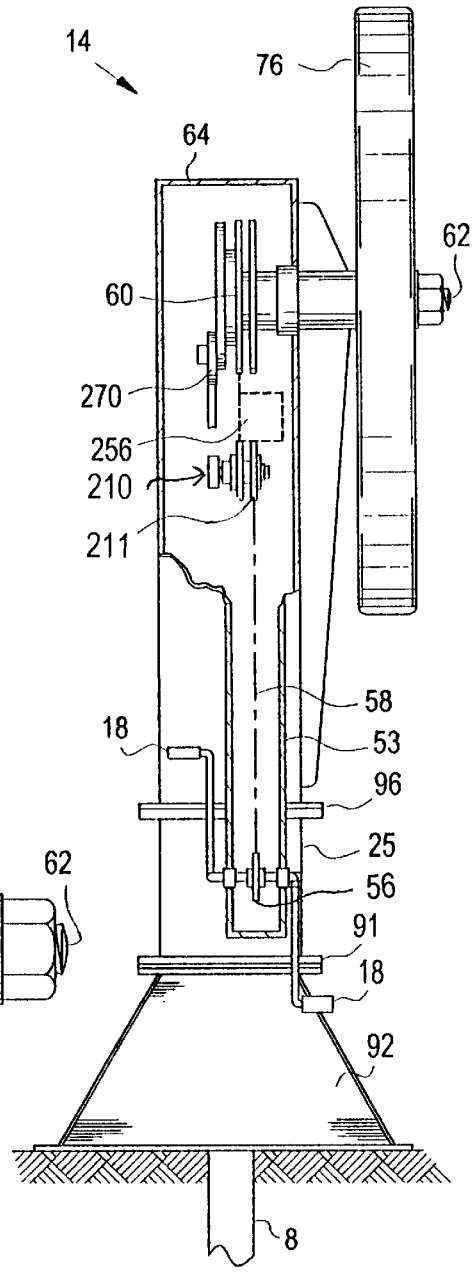
FIG. 3 is a vertical cross-sectional front view of the pumpstand of FIGS. 1 and 2.
Figure 5:
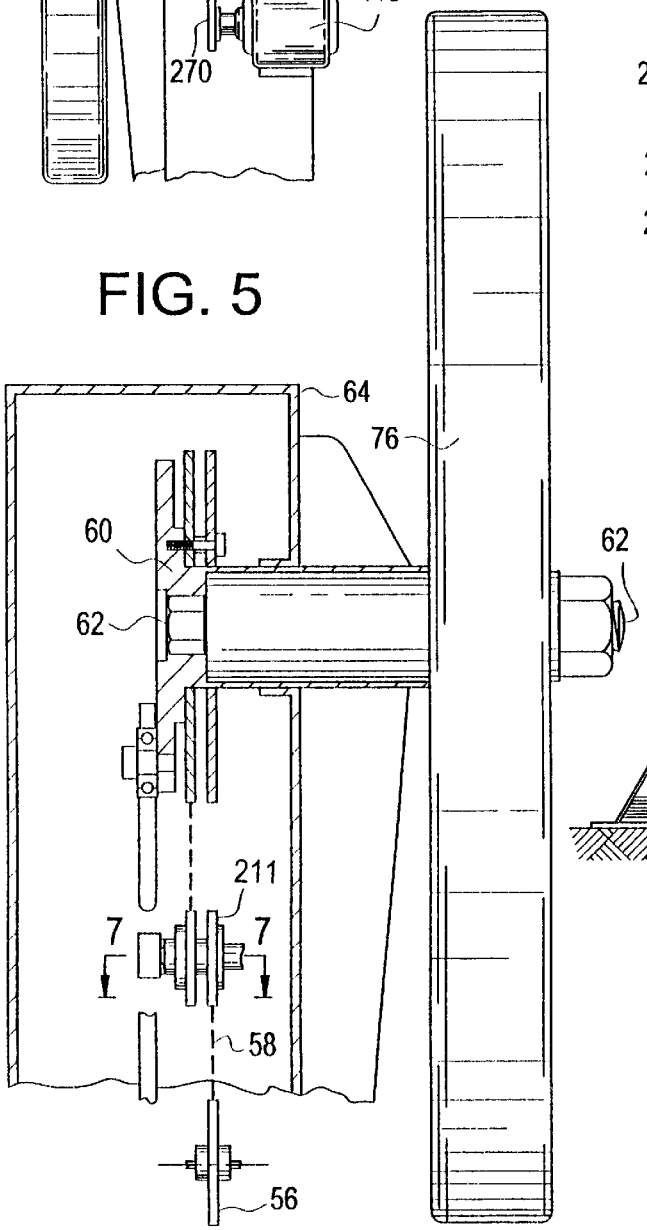
FIG. 5 is a broken-away, close-up cross-sectional front view of the top of the pumpstand.

Referring now to FIGS. 3 and 4, which show views of the mechanisms of pumpstand 14, positioned at the top of rising main 8. More specifically, FIG. 3 shows a vertical cross-sectional view and FIG. 4 shows a horizontal cross-sectional view. In FIGS. 1 and 2, various shields or housing sections 53, which are provided particularly to prevent personal injury by moving parts, are shown in cross-section to reveal the mechanisms installed therein.

As foot pedal 18, rotatably mounted in a pair of bearings 54, is operated, a drive sprocket 56, mounted to turn with foot pedal 18, drives a driving chain 58, which in turn causes the rotation of a double driven sprocket 60. Sprocket 60 is mounted firmly on a drive shaft 62, which is rotatably mounted within a housing 64 by means 12 of a pair of bearings 65. A connecting rod 66 is pivotally mounted to extend between an eccentric pin 68 extending from driven sprocket 60 and a fitting 70 at the top of a pushrod 71 connected to the pumprod. Pushrod 71 is mounted to slide vertically within a bearing structure 72. An idler sprocket 210, which is also rotatably mounted within housing 64, may be adjusted in position to maintain a suitable tension on driving chain 58.

A flywheel 76 is also attached to turn with shaft 62, with a spoke 78, having a radial slot 80, extending diametrically opposite eccentric pin 68. A counterweight 82 is clamped in place on flywheel 76 by means of a pair of screws 84 extending through the slot to engage a clamping plate 88. A flywheel housing 90 may be included to protect others from the rotating flywheel 76. With this arrangement, the counterweight is moved to its lowest position as the pumprod is moved to its highest position, and vice versa. In this way, the counterweight is used to counterbalance the combined weight of the pumprod, of the plunger and of the water within rising main 8 and within the rising portion of discharge pipe 24. The counterweight balances the work done during the pumping stroke to that of the downward stroke.

Using the screws, the position of the counterweight 82 may be adjusted along the length of the slot 80. Since the combined weight to be counterbalanced varies greatly with the depth of the well and the height of discharge pipe 24, this adjustment is used to customize pumpstand 14 as it is installed on an individual well. After the initial installation process, the position of the counterweight 82 may be changed to accommodate changes to the system, such as variations in the height of the discharge pipe 24, changes in the depth of well, or even preferences of the user. In providing an adjustment, pumpstand 14 provides a significant advantage over the Climax handpump, described above, which has a counterbalance mounted in a fixed position.

Figure 14:
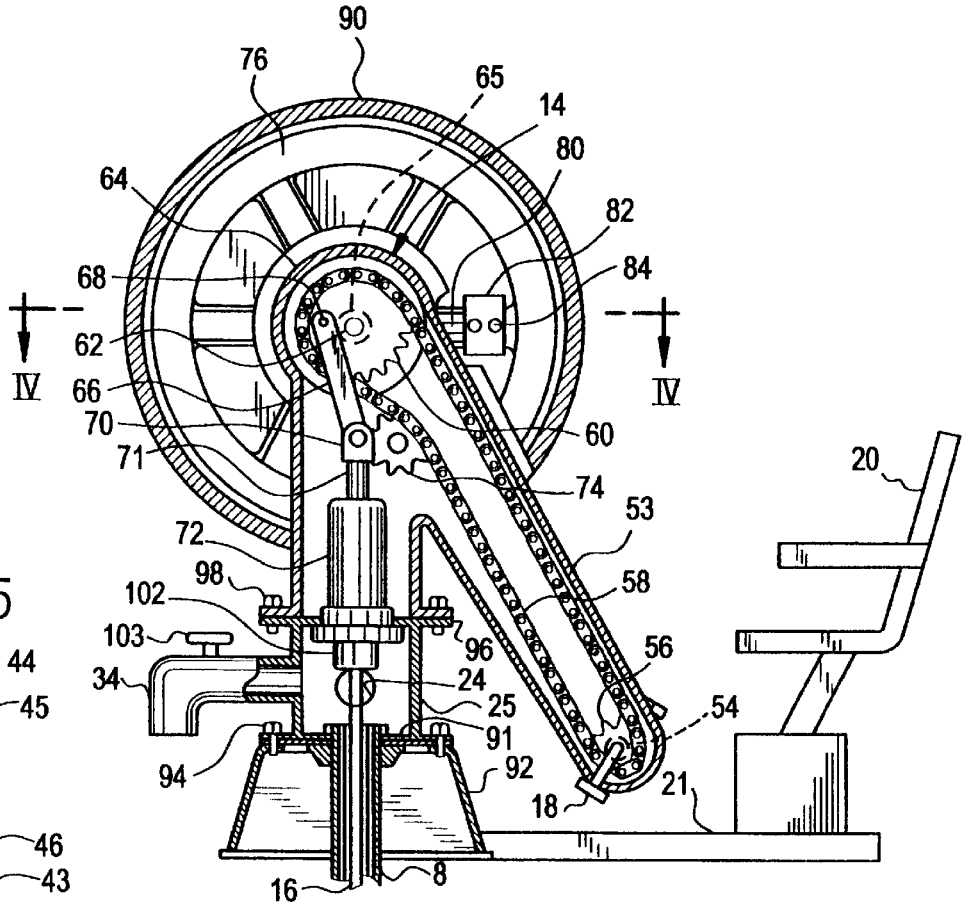
FIG. 14 is a vertical cross-sectional view of an underground cylinder portion of the system of FIG. 13.
Figure 15:
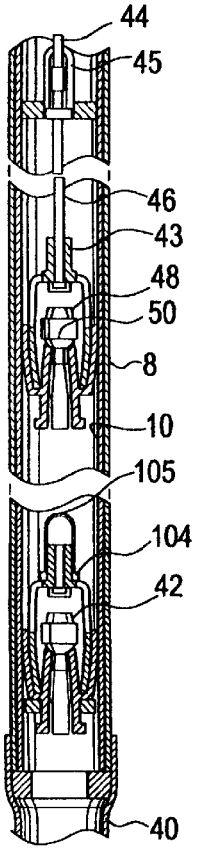
FIG. 15 is a vertical cross-sectional view of a pumpstand of the system of FIG. 13.

During operation of the water supply system, water is brought upward through rising main 8 into pressure tight chamber 25 between an lower flange plate 91, fastened atop base 92 with a number of screws 94, and an upper flange plate 96, to which pumpstand housing 64 is in turn fastened with screws 98. First bibcock 34 and discharge pipe 24 extend from the pressure tight chamber 25. Pressure is maintained within chamber 25 through the use of a pressure seal 102, which prevents the leakage of water into the bearing structure. The conventional valve mechanism within bibcock 34, operated by a handle 103, forms another part of the system sealing chamber 25 whenever this bibcock 34 is closed. Valve mechanism 34 is a relief valve set to operate when the filter or any other component restricts the flow of water. Valve 34 is factory set to slightly above the maximum operating pressure of the system for greater safety. See FIGS. 11 and 14.

In this way, pumpstand 14 is provided with a significant advantage over conventional pumpstands producing reciprocating motion, in that conventional pumpstands do not include a plate extending across the top of the well in this way, or any method for sealing around a rod descending into the rising main. Therefore, a conventional pumpstand can only provide water through a spout extending at the low level of first bibcock 34.

On the other hand, the pumpstand 14 can pump water under pressure into elevated tank 27, forming part of a water supply system providing water to individual houses or other remote locations. The use of a storage tank in this way also allows the drawing of water for use to occur at a different time than the pumping of the water.

Referring to FIGS. 2 and 3, while a pressure tight chamber 25 is provided, the entire pumpstand 14 may be removed by loosening screws 98, and the pressure tight chamber 25 may be removed from the well by loosening screws 94. Discharge pipe 24 is preferably connected to chamber 25 by conventional, removable means to facilitate this process. In this way, access is provided to allow the plunger to be lifted out of the well, for maintenance, by means of the pumprod. Footvalve structure 104 is fitted with a loop 105, so that it may also be lifted out of the well in this way.

Figure 9:
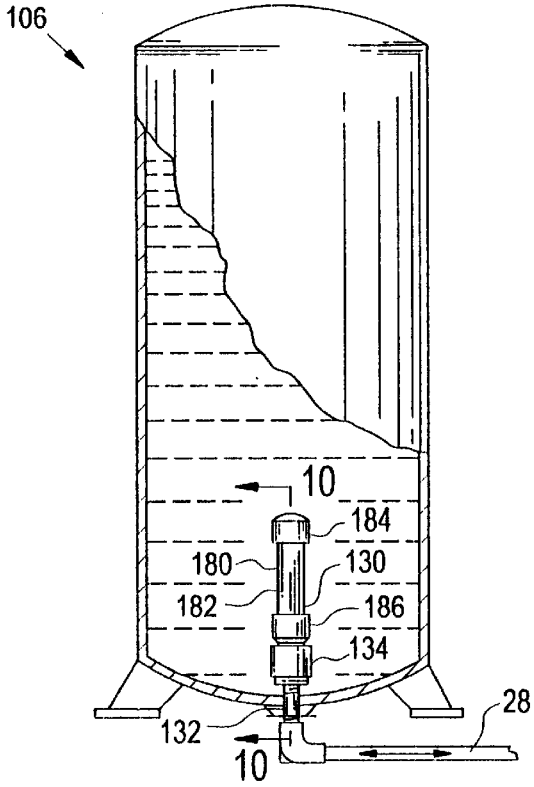
FIG. 9 is a vertical cross-sectional view of the preferred pressure tight water storage having the inventive float assembly at its lower end.

Referring now to FIG. 9, a cross-sectional view of a pressure tight water tank 106 is shown. Tank 106 may be used in place of the elevated water tank 27, shown in FIG. 1. As water is pumped into pressure tight tank 106 from discharge pipe 24, the air held in tank section 108 above the water level is compressed, providing pressure to force water through distribution pipe 28 extending from the tank 106 as faucets 32 or other valves along distribution pipe 28 are opened. The use of air pressure in this way makes it unnecessary to place tank 106 on an elevated structure.

Figure 6:
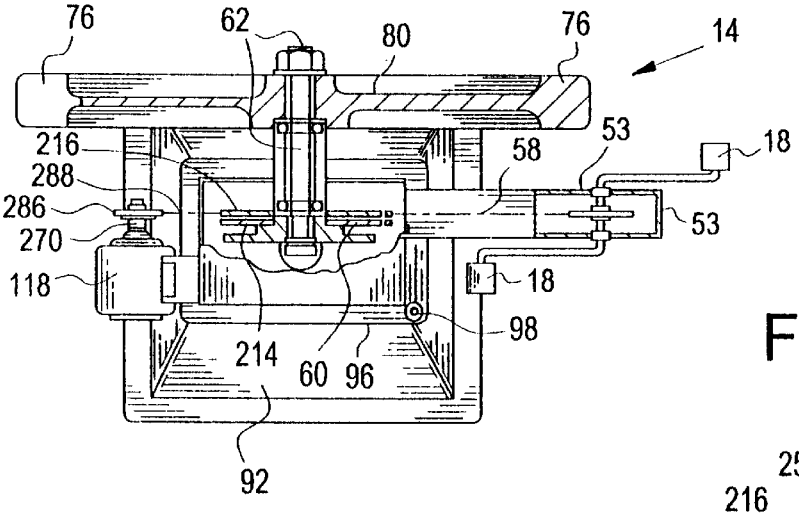
FIG. 6 is a horizontal cross-sectional view of a portion of the pumpstand of FIGS. 1 and 2.
Figure 11:
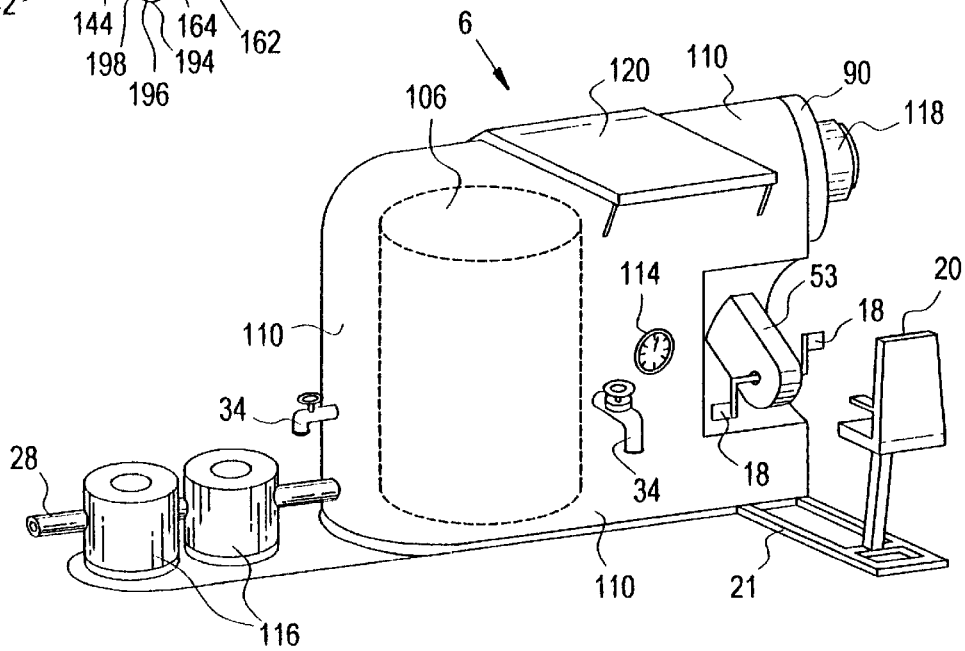
FIG. 11 illustrates the pumping station and water storage unit in a common housing, adapted for easy setup at a remote village.

Referring now to FIG. 11, a housing 110 for containing pumping station 6 and a water storage unit is shown. Where previously described elements are shown in FIG. 6, like reference numerals are used. A precharged water tank 106 is included within housing 110. See FIGS. 9 and 11.

In order to maintain a sufficient water level in tank 106 to prevent the escape of pressurized air above the tank water level, a float assembly 130 is provided. Float assembly 130 functions to keep the passage of water out of tank 112 open as long as the water level is above a certain pre-set minimum point. Should the water level drop to that pre-set point, float assembly 130 closes the outlet water opening 132 in tank 112 against further water outflow.

Float assembly 130 is mounted vertically at the water pipe opening 132 at the bottom of tank 112. Float assembly 130 preferably includes a check valve body 134 having a base fitting 136 including a generally disk-shaped adaptor portion 142 preferably made of polyvinyl chloride having an internally threaded central bore 144 sized and threaded to fasten onto the threaded distribution pipe 28 end. An annular flange portion 146 extends upwardly from the circumferential edge of adaptor portion 142. A cap structure 150 press fits over the circular exterior of base fitting 136 and includes a tubular side wall 152 with a top wall 154 having a top wall central cap recess 156. At the center of cap recess 156 is a rod port 162 surrounded at its lower opening by an annular port flange 164. A water passing cap opening 166 is provided adjacent to rod port 162 within cap recess 156. A circumferential cap channel 172 is preferably provided in the upper surface of cap top wall 154 and extends around cap recess 156.

Finally, a float structure 180 is provided which includes a float body tube 182 having an upper tube cap 184 fitted snugly and sealingly over the upper end of body tube 182, and a lower tube cap 186 also fitted snugly and sealingly over the body tube 182 lower end. Lower tube cap 186 has a lower tube cap rod receiving bore 192 in its lower surface, and a stop rod 194 press fitted into rod receiving bore 192. Stop rod 194 passes slidingly through rod port 162 and has a threaded rod lower end 196 fitted with an adjustable stop nut 198. Stop nut 198 of stop rod 194 permits float structure 180 to move upward only to a point at which stop nut 198 abuts the lower end of annular port flange 164. The sides of lower tube cap 186 are downwardly tapered at the cap 186 lower end, and a gasket seal groove 202 extends around the circumference of lower tube cap 186 within the tapered segment. A gasket seal 204 formed of rubber or other similar and suitable material is seated within groove 202 and sized to abut cap structure top wall 154 at the outer edge of recess 156 to releasibly close water passing cap opening 166 in the structure 150 top wall 154.

A quantity of air or other suitable gas is trapped within sealed float structure 180, and makes float structure 180 buoyant. As a result, as water is introduced into tank 112, and reaches a certain level around float structure 180, float structure 180 buoyantly rises until stop nut 198 abuts port flange 164. This opens the water passing cap opening 166 for delivery of water from tank 112, by lifting gasket seal 204 off cap structure top wall 154. Once water has drained from tank 112 to an extent that the water level within tank 112 drops to the pre-set point relative to float structure 180, float structure 180 is no longer surrounded by sufficient water to float, and float structure 180 drops to rest on base fitting 136, with gasket seal 204 abutting and making sealing contact with cap structure top wall 154. As a result, no further water can escape from tank 112 until the water level within tank 112 is again raised above the pre-set point and float structure 180 again buoyantly rises off base fitting 136. The resulting minimal water layer remaining in tank 112 at all times prevents the escape of pressurized air above the water within tank 112, which provides the force needed to drive water from tank 112 throughout a distribution system 300.

Internal piping within housing 110 (not shown) connects the pumping station 6 mechanisms, shown in FIGS. 2–4, to tank 112 in a conventional manner. This piping may include a debris trap or filter (not shown) for preventing sand or small stones from entering precharged tank 112. Similarly, internal piping connects the output from precharged tank 112 to a plurality of bibcock 34 located on housing 110, as well as to distribution pipe 28. In addition, a pressure gauge 114 may be added to provide the operators with information of the available pressure of the water leaving precharged tank 112.

Because of the inclusion of flywheel 76, the effort needed to maintain the continued operation of the pumping station 6 is not great, particularly when precharged tank 112 is not full. In fact a small electric motor 118 may be affixed to flywheel housing 90 to provide a rotational force to flywheel 76. Motor 118 may be powered by a small solar panel 120 located on an adjustable stand (not shown) to track the maximum intensity of the sun, since conventional electric power is not generally available in the areas where this invention will be used. It should be noted that motor 118 only maintains the rotation of flywheel 76. Manual use of foot pedal 18 will still be required to start the pumping action of pumping station 6. Otherwise, manual use of foot pedal 18 is required only when the intensity of sunlight is low.

In order to prevent motor forced rotation of pedal 18, a one-way engagement pedal clutch assembly 211 is provided. See FIGS. 1 and 6. Pedal clutch assembly 211 preferably takes the form of a standard drawn cup roller clutch 212, fitted with laterally spaced apart first and second pedal sprockets 214 and 216. Pedal clutch assembly 210 also serves as an adjustor. Any other suitable clutch may be substituted.

Pedal clutch 212 preferably includes two sealing rings (not shown), two bearing washers 224, a retaining ring (not shown), drawn cup roller bearings 232, a stripper bolt 234 and first and second clutch flanges 242 and 244. Sprockets 214 and 216 are roller chain sprockets, are annular and fit snugly over the pedal clutch 212 housing, and each have threaded screw ports 252 which register with screw openings 254 in first and second clutch flanges 242 and 244. Sprockets 214 and 216 are respectively fastened to flanges 242 and 244 with flange screws 246 in the form of six button head cap screws.

Pedal clutch assembly 210 engages to transmit rotational motion and torque to drive shaft 62 through link chain 256 to sprocket 60 only when pedal 18 is itself driven in a forward rotational direction by an operator, and disengages to spin freely if spun in the opposite rotational direction, such as when second pedal sprocket 216 is driven by motor 118. As a result, motor driven rotation is not transmitted to first pedal sprocket 214. In this way, clutch assembly 210 protects the human operator from injury from impact of a rearward spinning pedal 18.

Figure 7:
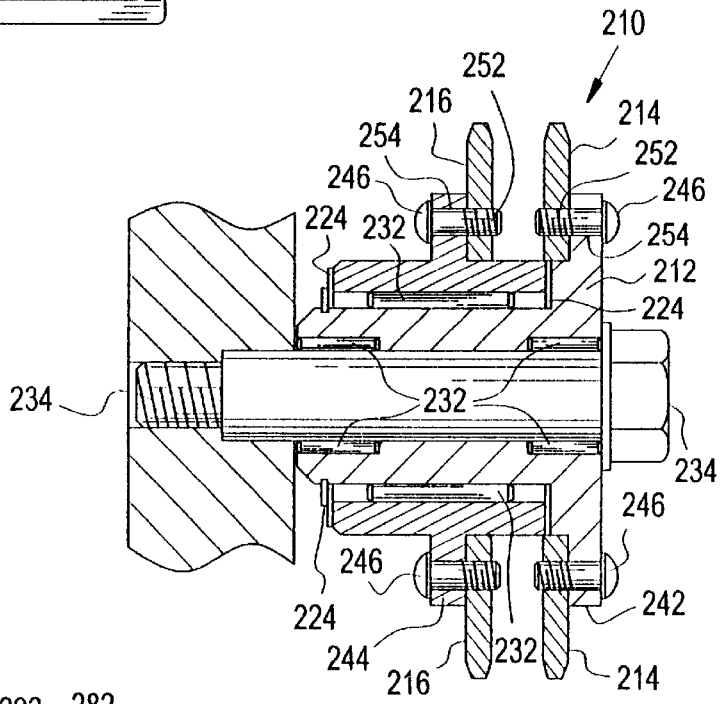
FIG. 7 is a cross-sectional side view of the pedal clutch assembly having the two sprockets.
Figure 8:
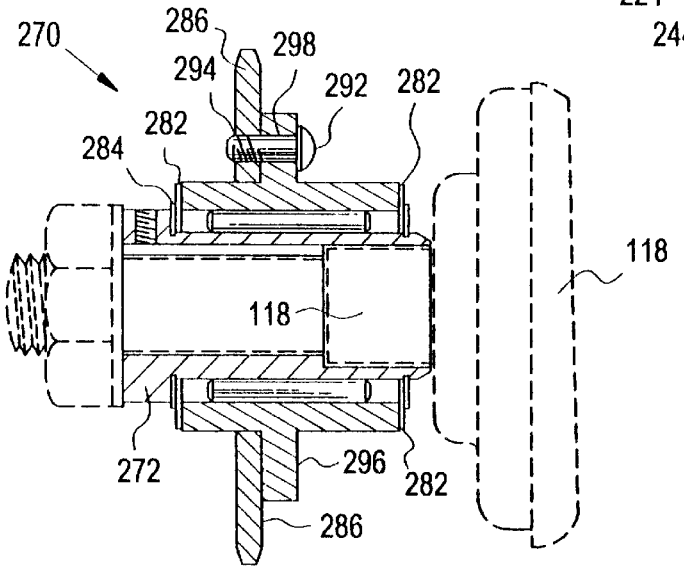
FIG. 8 is a cross-sectional side view of the motor clutch assembly having the single sprocket.
Figure 10:
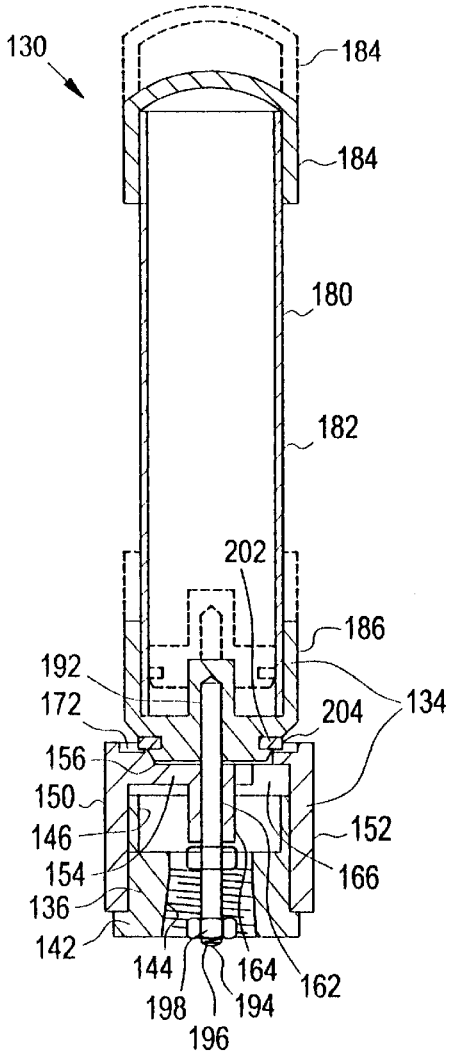
FIG. 10 is a close-up, cross-sectional view of the float assembly in the tank of FIG. 9.

In order to prevent potentially damaging pedal driven rotation of motor 118, a one way engagement motor clutch assembly 270 is provided. See FIGS. 1 and 7. Motor clutch assembly 270 preferably takes the form of a standard drawn cup roller clutch 272, such as part number HFL 3030 manufactured by I & A, fitted with a motor sprocket 274. Once again, any other suitable clutch may be substituted.

Motor clutch assembly 270 preferably includes drawn cup roller clutch 272, two sealing rings (not shown), two bearing washers 282, a retaining ring 284, one roller chain sprocket 286, three button head cap flange screws 292, two set screws 294 and a flange 296. Sprocket 286 is annular and fit snugly over the motor clutch 272 housing, and has threaded screw ports 294 which register with screw openings 298 in motor clutch flange 296. Sprocket 286 is fastened to flange 296 with flange screws 292.

Motor clutch assembly 212 engages to transmit rotational motion and torque to pedal clutch 212 only when the motor 118 shaft is driving chain 288, and disengages to spin freely when chain 288 spins sprocket 286 under separate power. In this way motor clutch assembly 270 is similar functionally to the clutch in the pedal hub of a typical ten-speed bicycle. As a result, the shaft of motor 118 never rotates unless driven by motor 118 itself.

A water treatment system 116 may be placed within housing 110 between the pumping station 6 and precharged tank 112 along with the debris trap.

Figure 12:
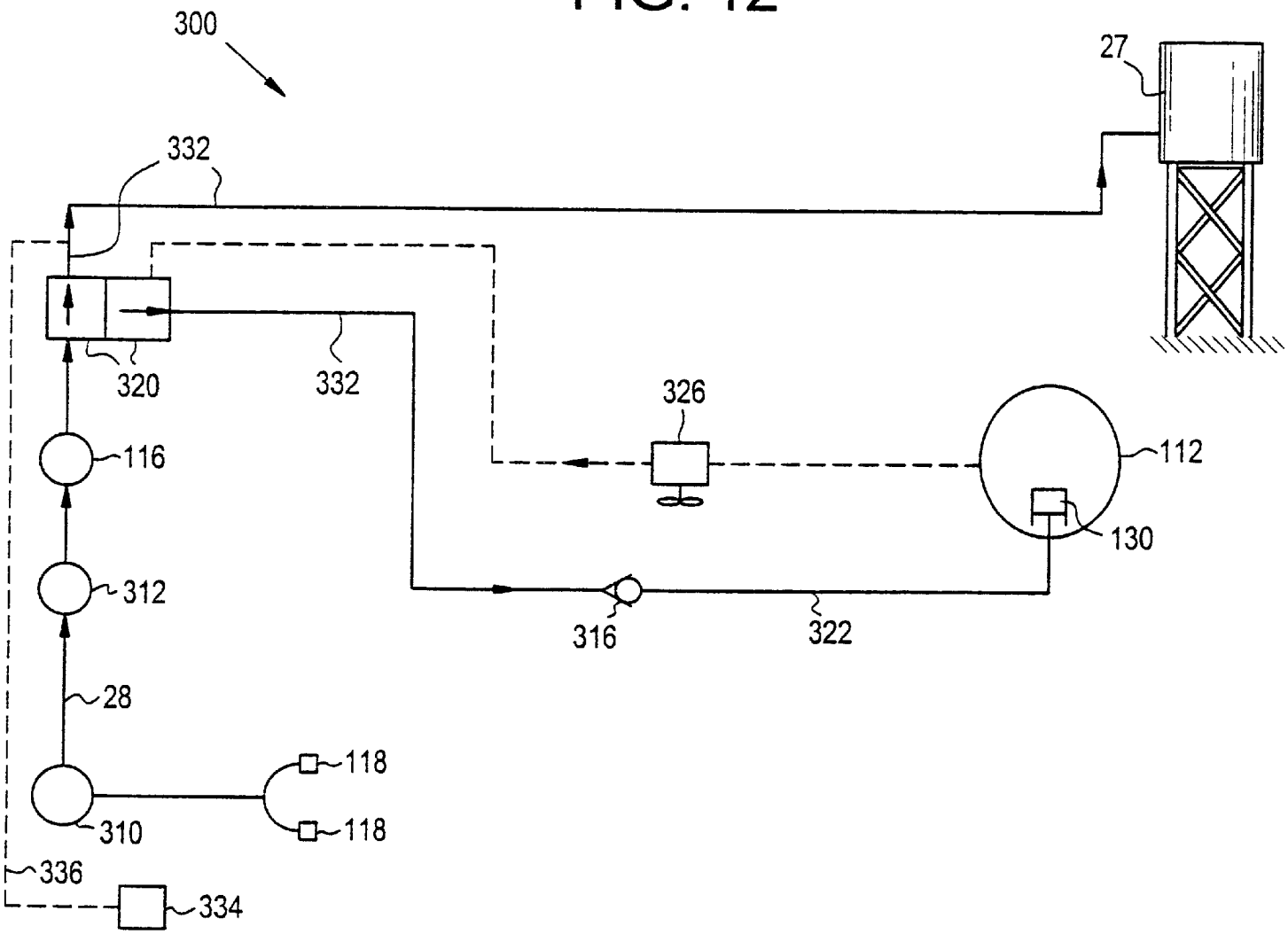
FIG. 12 is a schematic view of the preferred water distribution system, having both the pressure tank and the water tower, and a sequence valve alternating water flow to the pressure tank until full, and then to the water tower, or vice versa.

Alternatively, a water delivery system 300 is provided including a sequence valve 320 for diverting the flow of pumped water from the pressure tank 112 when tank 112 becomes full. As shown in the schematic illustration of FIG. 12, water delivered from pump 310, whether under pedal 18 or solar powered motor 118, is delivered through distribution pipe 28 to a filter 312 to a water treatment device 116, and from water treatment device 116 to a pilot operated sequence valve 320. A first branch pipe 322 extends from sequence valve 320 to pressure tank 112 through a non-return valve 316, and enters tank 112 through float assembly 130. An adjustable pilot 326 is connected to a pressure or water level sensor (not shown) in tank 112 and to sequence valve 320. When the pressure or water level inside tank 112 reaches a certain pre-set point, adjustable pilot 326 sends a hydraulic signal to sequence valve 320 and causes valve 320 to divert the water flow from pump 310 to a second branch pipe 332 leading to overhead water tank 27. Finally, a pressure switch 334 is connected to second branch pipe 332. When pressure within second branch pipe 332 reaches a level indicating that overhead water tank 27 is full, pressure switch 334 disconnects the solar power supply in the form of solar panel 120 to the electric motor 118 and stops the further operation of the water pump.

While the invention has been described in its preferred form or embodiment with some degree of particularity, it is understood that this description has been given only by way of example and that numerous changes in the details of construction, fabrication and use, including the combination and arrangement of parts, may be made without departing from the spirit and scope of the invention.

What is claimed is:

1. A pumpstand for driving a pumprod in a vertically reciprocating motion, said pumpstand comprising:

a pumpstand housing;

a drive shaft rotatably mounted within said housing, with a driven sprocket and a flywheel attached to said drive shaft;

transmission means for converting rotary motion of said drive shaft into said vertically reciprocating motion of said pumprod;

a counterweight turning with said drive shaft, wherein said counterweight is raised as said pumprod is lowered, and wherein said counterweight is lowered as said pumprod is raised;

an electric motor;

a motor driving sprocket;

a chain extending between said motor driving sprocket said driven sprocket, said chain engaging said sprockets such that rotation of said driven sprocket causes rotation of said motor driving sprocket;

and, a motor clutch containing means for rotational engagement in only one rotational direction interconnecting said electric motor and said motor driving sprocket which engages when said electric motor operates to drive said motor driving sprocket and disengages when said motor driving sprocket is driven by said chain without operation of said motor, such said electric motor is not driven by rotation of said driven sprocket.

2. The pumpstand of claim 1, wherein said counterweight is attached to said drive shaft in a manner allowing adjustment of a radial distance between said drive shaft and said counterweight.

3. The pumpstand of claim 2, wherein said flywheel includes a radially extending structure along which said counterweight is attached.

4. The pumpstand of claim 3, wherein said radially extending structure is an aperture slot through which said counterweight is fastened to said flywheel.

5. The pumpstand of claim 1, wherein said transmission means comprises: an eccentric pin turning with said drive shaft;

a pushrod extending downward from said pumpstand, said pushrod being mounted to slide vertically; and a connecting rod extending between said eccentric pin and said pushrod, said connecting rod being rotatably mounted on said eccentric pin and pivotally mounted on said pushrod.

6. The pumpstand of claim 5, further comprising:

a plate with an aperture through which said pushrod extends within a pressure seal; said plate separating a chamber from a portion of said transmission means; and connecting means for connecting a discharge pipe to said chamber.

7. The pumpstand of claim 1, further comprising a plate separating a chamber from a portion of said transmission means;

means for connecting a discharge pipe to said chamber; and pressure sealed transmitting means for transmitting reciprocating motion through said plate.

8. The pumpstand of claim 1, further comprising a seat for sitting upon to operate said foot pedal.

9. A pumpstand for driving a pumprod in a vertically reciprocating motion, said pumpstand comprising:

a pumpstand housing;

a drive shaft and a drive sprocket rotatably mounted within said housing, and a flywheel attached to said drive shaft;

a first driven sprocket and a second driven sprocket mounted on a one-way engagement drive-shaft clutch;

transmission means for converting rotary motion of said drive shaft into said vertically reciprocating motion of said pumprod;

a counterweight turning with said drive shaft, wherein said counterweight is raised as said pumprod is lowered, and wherein said counterweight is lowered as said pumprod is raised;

a foot pedal rotatably mounted within said housing, with a pedal driving sprocket attached to said foot pedal;

a first chain extending between said pedal driving sprocket and said first driven sprocket, said first chain engaging said sprockets such that rotation of said driving sprocket causes rotation of said first driven sprocket;

a second chain extending between said second driven sprocket and said motor drive sprocket, said second chain engaging said sprockets such that rotation of said motor drive sprocket causes rotation of said second driven sprocket;

wherein said drive-shaft clutch contains engaging means for rotational engagement in only one rotational direction interconnecting said first driven sprocket and said second driven sprocket which engages when said first chain drives said first driven sprocket and disengages when said first driven sprocket is driven by said first chain without operation of said pedal, such said pedal is not driven by rotation of said second driven sprocket.

* * * * *